US006903284B2

(12) United States Patent
Dunfield et al.

(10) Patent No.: US 6,903,284 B2
(45) Date of Patent: Jun. 7, 2005

(54) TIMED SWITCH CONTROL FOR ELECTRIC DEVICES

(76) Inventors: Linda Williams Dunfield, 1325 NW. Heather Dr., Corvallis, OR (US) 97330; John Stephen Dunfield, 1325 NW. Heather Dr., Corvallis, OR (US) 97330

( * ) Notice: Subject to any disclaimer, the term of this patent is extended or adjusted under 35 U.S.C. 154(b) by 0 days.

(21) Appl. No.: 10/630,996

(22) Filed: Jul. 30, 2003

(65) Prior Publication Data

US 2005/0023118 A1 Feb. 3, 2005

(51) Int. Cl.[7] ..... H01R 24/00

(52) U.S. Cl. ..... 200/51 R; 200/50.03; 307/141

(58) Field of Search ..... 200/51 R, 51.05, 200/51.06, 51.09, 51.11, 51.12; 307/40, 41, 64, 139, 141, 150; 361/111, 115, 116, 785, 765; 174/48, 70, 785; 324/508; 439/650–654, 207–218, 954, 535, 620, 622, 761, 101, 108, 52, 188, 501, 502

(56) References Cited

U.S. PATENT DOCUMENTS 4,001,527 A * 1/1977 Hulshizer ..... 200/38 FB
4,051,655 A 10/1977 Lorenz et al.
4,171,471 A 10/1979 Boyles
4,194,182 A 3/1980 Martin
4,318,181 A * 3/1982 Kawakami et al. ..... 702/176
4,494,012 A 1/1985 Coker
5,397,869 A 3/1995 Huen
5,424,903 A * 6/1995 Schreiber ..... 361/166
5,430,598 A * 7/1995 Rodolfo et al. ..... 361/115
5,481,452 A 1/1996 Simmons
5,615,271 A 3/1997 Stevens et al.
5,699,320 A * 12/1997 Wan ..... 368/10
5,734,206 A * 3/1998 Keizer et al. ..... 307/116
5,742,466 A * 4/1998 Kram ..... 361/118
6,167,000 A * 12/2000 Chow ..... 368/107
6,329,616 B1 * 12/2001 Lee ..... 200/51.03
6,476,523 B1 * 11/2002 Lee ..... 307/141

* cited by examiner

*Primary Examiner*—Michael A. Friedhofer

(57) ABSTRACT

A power switch control unit for controlling the operation of a controlled electric device connected to the unit includes a housing having a timing mechanism therein; a power cord having a plug on one end thereof, for connection to a power supply, and having the housing on the other end thereof, for supplying electrical power to the unit and to a connected-electric device controlled by the power switch control unit, and a receptacle for receiving a power cord from an electric device to be controlled by the power switch control unit; control buttons, including: an on/off button for connecting a controlled electric device to the power supply; a timer activation button for activating the timing mechanism, wherein, when the timing mechanism is activated, it connects a controlled electric device to the power supply for a predetermined amount of time in a timed cycle, and then disconnects the connected-electric device from the power supply; and a clear timer button for terminating the predetermined amount of time, and a display for displaying time remaining in the predetermined period of time.

16 Claims, 4 Drawing Sheets

TIMED SWITCH CONTROL FOR ELECTRIC DEVICES

FIELD OF THE INVENTION

This invention relates to switch controls for electric devices, and specifically to a switch control which facilitates operation of electric devices by mobility impaired individuals.

BACKGROUND OF INVENTION

For many people, including seniors, the arthritic, those who are convalescing, or those with physical disabilities, twisting and reaching for small buttons, such as those on a radio, or switches, such as those under a lamp shade, can be painful, and in some cases, dangerous. Lamps may tip over or hands may contact hot light bulbs. Furthermore, the mere act of manipulating and grasping some switches may be extremely difficult for those with arthritic hands or similar mobility disabilities. Many devices have been provided to resolve the problems of accessibility and ease-of-use of power switches.

People with impaired memory, such as attention deficit hyperactivity disorder (ADHD), autism, Alzheimer's Disease, senile dementia, or the like, or those who are easily distracted, may leave a room and forget to turn off electric devices. Leaving electric devices on when not needed wastes energy, money and may constitute a safety hazard.

Some people may fall asleep with an electric device on, such as a reading lamp, a radio or a television. At other times, some people, including young children, may wish to be comforted by an electric devices while falling asleep, by having a lamp, television, fan and/or audio unit on, however, when the user falls asleep, the electric device continues to operate, wasting energy, money and possibly creating an unsafe condition. Many timer devices have been provided to resolve the aforementioned problems, however, most timing devices are complex, are installed in inconvenient locations, and may be difficult to operate, especially by those with physical and/or mental impairments.

Some people may wish to limit the time that use of a particular electric device is available, e.g., limiting television-viewing time for young children. Moreover, nighttime readers may need help in limiting the amount of time they read. A reader may become so involved in reading that they lose track of time. This event, while pleasurable at the time, may result in an inadequate amount of sleep. Setting time limits provides feedback for people, such as those with ADHD, autism, memory loss or others wishing to modify their behavior. Conventional timers, which can be programmed by a user provide a set operation time, however, because they must be plugged in right at the wall outlet, they may be inaccessible and inconvenient when a user desire to use the timer spontaneously, or when the user desires to change a timer setting.

U.S. Pat. No. 5,615,271 to Stevens et al., describes a Method and apparatus for activating switches in response to different acoustic signals. The method of clapping ones hands turns an electric device on or off. This apparatus provides accessibility and ease-of-use of electric devices, however, one must be awake to operate this device. Thus if the user falls asleep, electric devices remain powered on, thus wasting energy and money. The requirement of needing to be awake to turn a device off is also present in known wireless remote control units.

U.S. Pat. No. 4,171,471 to Boyles, describes a programmable timer, which plugs into a wall outlet. This device does not require a user to remain awake, however, the timer must be preprogrammed and not easily accessible when a use has a spontaneous need to change the timer. Furthermore, as the device of the '471 patent must be located near a wall outlet, which is usually located at a low level, and is frequently located behind furniture, accessibility and spontaneity are difficult.

U.S. Pat. No. 5,481,452 to Simmons describes a programmable switching unit, which may be incorporated in a wall switch for installation in a standard switch box. This timer and power switch addresses the accessibility, ease-of-use and timing issues, however, it requires a hard-wired installation, as it must be electrically connected to a wall switch.

There are other known wall switch timers, which require rotation of a setting mechanism, which audibly clicks down the time, which may be an annoyance, especially when one is trying to fall asleep. Other wall switch timers that silent and require a user only to press a switch or button, however, such timers still require installation of the unit into the wall switch box.

SUMMARY OF INVENTION

A power switch control unit for controlling the operation of a controlled electric device connected to the unit includes a housing having a timing mechanism therein; a power cord having a plug on one end thereof, for connection to a power supply, and having the housing on the other end thereof, for supplying electrical power to the unit and to a connected-electric device controlled by the power switch control unit, and a receptacle for receiving a power cord from an electric device to be controlled by the power switch control unit; control buttons, including: an on/off button for connecting a controlled electric device to the power supply; a timer activation button for activating the timing mechanism, wherein, when the timing mechanism is activated, it connects a controlled electric device to the power supply for a predetermined amount of time in a timed cycle, and then disconnects the connected-electric device from the power supply; and a clear timer button for terminating the predetermined amount of time, and a display for displaying time remaining in the predetermined period of time.

It is an object of the invention to provide a on/off/timer control unit that (1) does not need to have the current time of day set therein; (2) is easily accessed and may be placed on a horizontal surface, such as a tabletop, a desk or a nightstand, or mounted oh a vertical surface, such as a wall or headboard; (3) does not need to be located near an electrical outlet; (4) is not preprogrammed; and (5) may be spontaneously set, to facilitate easy and frequent usage.

Another object of the invention is to provide an on/off/timer control unit which is quiet and will not disturb sleeping or concentrating or enjoyment of other listening.

A further object of the invention is to provide an on/off/timer control unit which is easy to use, has simple operating protocols, and has large, easily seeable and reachable control buttons.

Another object of the invention is to provide an on/off/timer control unit which is easy to set for predetermined, short intervals.

Another object of the invention is to provide an on/off/timer control unit which is able to provide biofeedback to a user.

Still another object of the invention is to provide an on/off/timer control unit which employs safety and power conditioning devices, such as GFI (Ground Fault Interrupter), AFCI (Arc Fault Circuit Interrupter), circuit breakers or other similar devices.

DETAILED DESCRIPTION OF THE PREFERRED EMBODIMENTS

Figure 1:
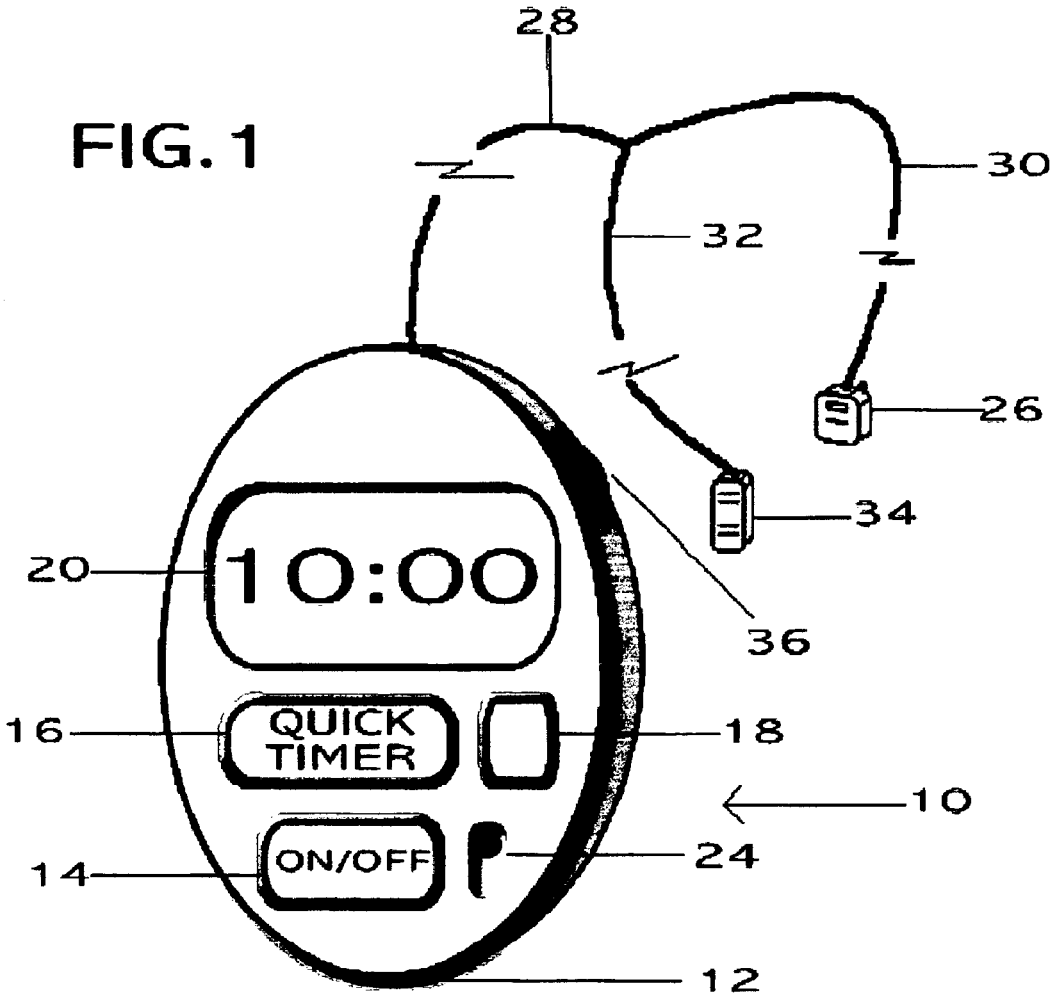
FIG. 1 is a perspective view of a first embodiment of the power switch control unit of the invention.

FIG. 1 is a perspective view of a first embodiment of a power switch control unit 10 of the invention, which embodiment is intended for use on a horizontal surface. Unit 10 includes a housing 12, which may have, in the preferred embodiment, dimensions of approximately four and one-half inches in length, three inches in width and about one-half inch in thickness. Housing 12, in the preferred embodiment, has an oval shape. Housing 12 may be formed of plastic, wood, metal or other attractive and serviceable compositions. Housing 12 may include a clip-on, changeable shell, which allows for customization and decorative choices.

An on/off button 14 may be located on housing 12, and may have the preferred dimensions of one inch by one-half inch, and may or may not have a textured surface for sensory/tactile identification. The large on/off button size facilitates easy use by the mobility/sensory impaired. Pressing on/off button 14 turns a connected-electric device on or off.

Housing 12 contains a timing mechanism, which is operable by a timer activation button 16. The timing mechanism is operated by depressing button 16, and will turn a connected-electric device on when button 16 is pressed. The timing mechanism may be hard-programmed to time out for a predetermined amount of time for a timed cycle, e.g., ten minutes. With unit 10 in this configuration, depressing button 16 three times in quick succession will set the timing mechanism for 30 minutes. In a variation of this embodiment, the timed cycle may be user-set by simultaneous activation of button 16 and another button, thereby adjusting the duration of the timed cycle. The timing mechanism may be set for timed cycles of 5, 10, 20, 30 or 60 minutes, and repeated operation of timer activation button 16 will set the predetermined amount of time to the total time for the number of timed cycles requested by the user. As in the case of on/off button 14, button 16 may have the preferred dimensions of one inch by one-half inch, and may or may not have a textured surface for sensory/tactile identification. The large on/off button size facilitates easy use by the mobility/sensory impaired.

A clear timer button 18 may be located on housing 12, and is operable to clear any remaining time left in the timing mechanism, and, if depressed, will turn a connected-electric device off. Button 18 may have a smaller dimensions than buttons 14, 16, as the use of this button is not as critical as is the use of buttons 14, 16.

Housing 12 includes a display 20, and, in the preferred embodiment, has dimensions of approximately two inches by one inch. Display 20 may be of the LED or LCD type, and likely has a soft light display when employed to offer visibility during the night, and yet not be too bright, so as to not disturb sleep or concentration of users. A dimmer may be included, and may be activated by, e.g., a display dimmer 22 (FIG. 2), located on the bottom of housing 12, by simultaneous operation of two button, or by a light sensor co-located with display 20.

A selector switch 24 may be located on housing 12. Selector switch 24 allows the user to select between connected devices, when unit 10 is configured for connection of more than one electrical device. Such an option allows a use to connect, e.g., a light and a radio, to control unit 10, and further allows independent operation of the devices. For instance, a person having set unit 10 to leave a radio and a light on for one hour may decide to turn the light off and leave the radio on for the remaining time period. Selector switch 24 is configured to allow individual selection of however many electric devices may be connected to unit 10. Display 20 includes an indicator which indicates which of plural connected-electric devices is selected by selector switch 24 to be selectively controlled. Selector switch 24 is also provided with an "All" setting, so that all of the connected-electric devices may be operated simultaneously.

A power plug 26 provide electrical power to unit 10, and also provided safety and power conditioning devices, such as GFI (Ground Fault Interrupter), AFCI (Arc Fault Circuit Interrupter), circuit breakers or other similar devices. Plug 26 is connected to one end of a power cord 28. Cord 28 may have a "Y" configuration, wherein one arm of the "Y" 30 is connected to plug 26, and the other arm 32 of the "Y" terminates in an outlet connector 34, which receives a power cord from an electric device(s) which is to be controlled by unit 10. Connector 34 may have plural receptacles, providing for the connection of multiple electric devices. The leg of "Y" cord 28 is connected to housing 12. Unit 10 may be provided with cords 28 of various lengths and configurations, and may be provided with plural connectors 34. Plug 26 may be configured to supply power to unit 10, and also contain a receptacle for receiving the plug from a connected-electric device to be controlled by unit 10. Cord 28 may be configured as a straight cord, with the functions of connector 34 incorporated into plug 26, or may be configured with plural arms/connectors to control plural electric devices.

Housing 12 may include a dimmer control 36, which is operable to dim a light connected to unit 10. One of ordinary skill in the art will recognize that a connector, such as connector 34, connected to this feature may only be used with lighting devices, and not other electric devices, such as radios, televisions, etc.

Figure 2:
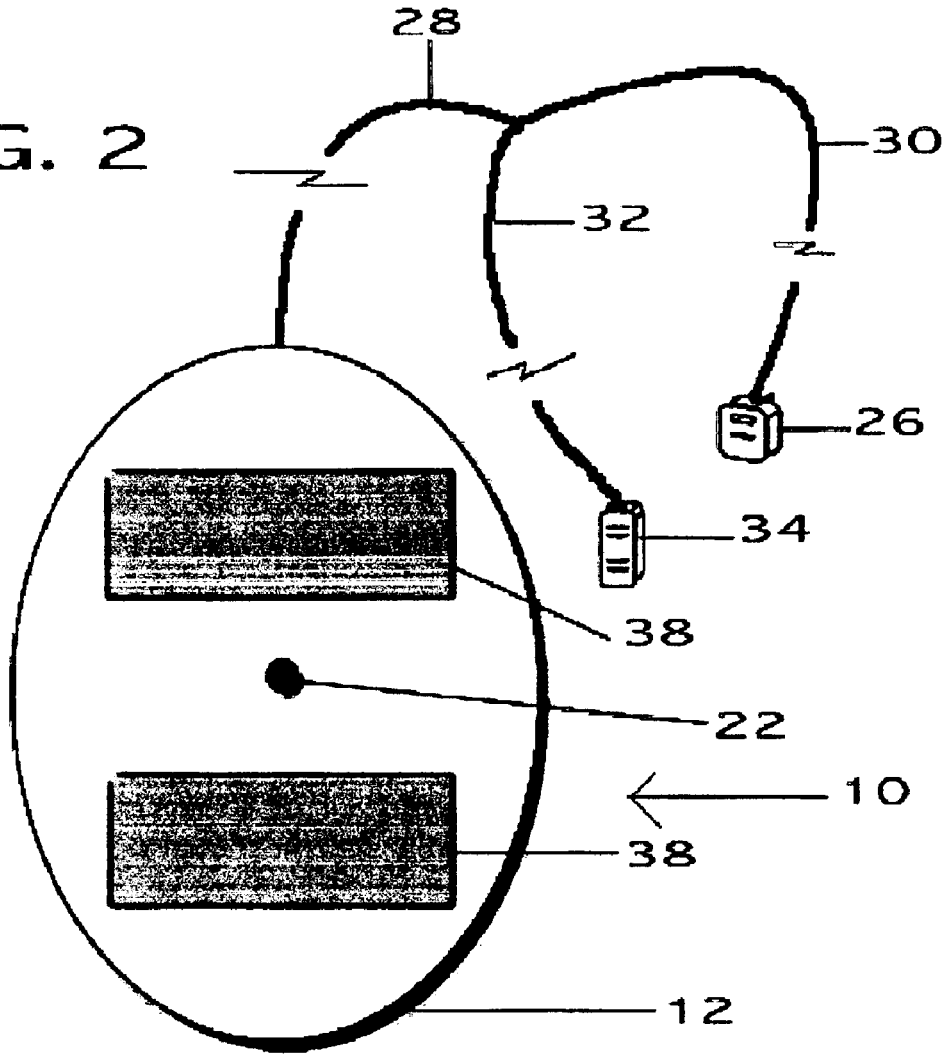
FIG. 2 is a bottom view of the embodiment of FIG. 1.
Figure 3:
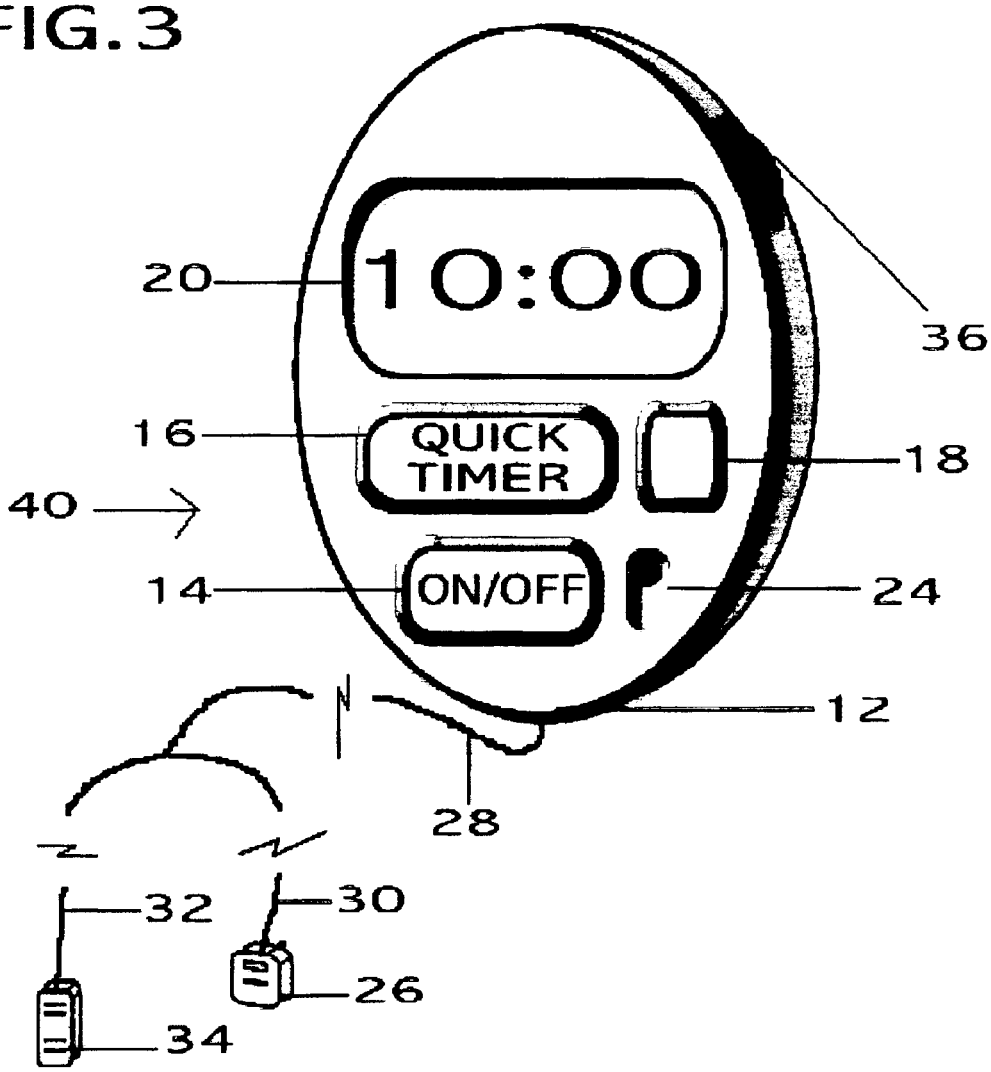
FIG. 3 is a perspective view of a second embodiment of the power switch control unit of the invention.
Figure 4:
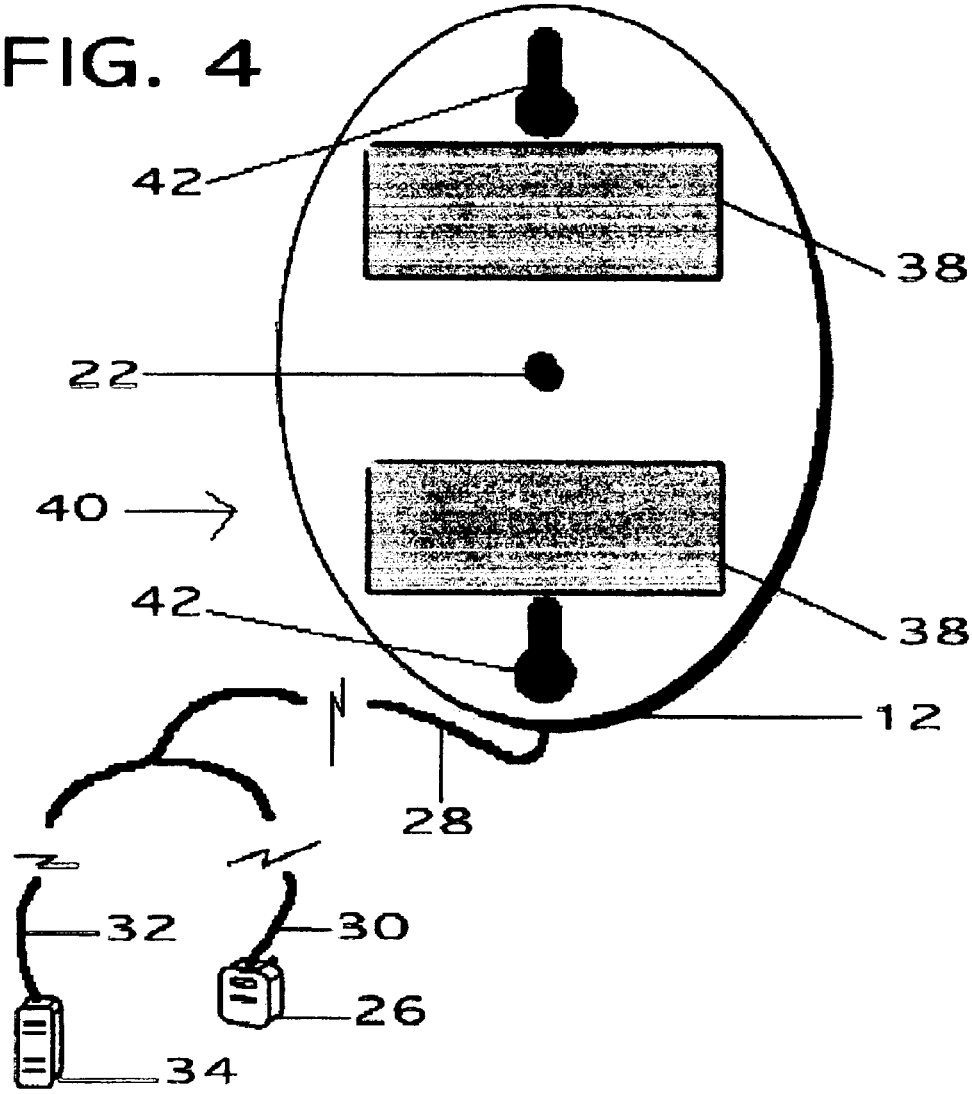
FIG. 4 is a bottom view of the embodiment of FIG. 3.

FIG. 2 depicts a bottom plan view of unit 10, showing non-slip pads 38, which are affixed to housing 12 to reduce slippage and movement. FIG. 3 depicts a second embodiment of power switch control unit 40, which includes, as shown in FIG. 4, mounts 42 suitable for mounting unit 40 on a vertical surface, such as a wall, headboard, cabinet, etc. The remaining features of FIGS. 3 and 4 are as in FIGS. 1 and 2, and bear similar reference numbers.

Unit 10 housing 12 and buttons 14, 16, 18 and switch 24 may be offered with a smooth surface, which make the unit easier to clean. Housing 12 may also be fabricated with embossed button pads having plastic overlays over electronic switches, so that the surface is integral, smooth and easy to keep clean. The embossed button pads eliminate mechanical buttons, which protrude through the panel and allow dirt to collect in the cracks and crevices around the buttons.

Thus, a power switch control unit for use with electric devices has been disclosed. It will be appreciated that further variations and modifications thereof may be made within the scope of the invention as defined in the appended claims.

We claim:

1. A power switch control unit for controlling the operation of a controlled electric device connected to the unit, comprising:

a housing having a timing mechanism therein;

a power cord having a plug on one end thereof, for connection to a power supply, and includes plural receptacles for connection of plural electric devices to said power switch control unit, and having said housing on the other end thereof, for supplying electrical power to the unit and to a connected-electric device controlled by the power switch control unit, and which further includes a selector switch for selectively operating said plural electric devices, and includes an indicator for indicating which of said plural electric devices is selected by said selector switch for control, and a receptacle for receiving a power cord from said electric device to be controlled by the power switch control unit;

control buttons, including:

a button for connecting a controlled electric device to the power supply;

a timer activation button for activating said timing mechanism, wherein, when said timing mechanism is activated, said timing mechanism connects a controlled electric device to the power supply for a predetermined amount of time in a timed cycle, and then disconnects the connected-electric device from the power supply; and a clear timer button for terminating the predetermined amount of time, and a display for displaying time remaining in said predetermined period of time.

2. The power switch control unit of claim 1 wherein said display includes an indicator for indicating which of said plural electric devices is selected by said selector switch for control.

3. The power switch control unit of claim 1 wherein said timing mechanism operates for a predetermined amount of time in a timed cycle upon operation of the timer activation button, and wherein multiple operations of the timer activation button program the timing mechanism to operate for multiple, sequential timed cycles.

4. The power switch control unit of claim 1 wherein the length of a timed cycle is user adjustable.

5. The power switch control unit of claim 1 wherein said plug includes safety and power conditioning devices taken from the group of safety and power conditioning devices including GFI (Ground Fault Interrupter), AFCI (Arc Fault Circuit Interrupter) and circuit breakers.

6. The power switch control unit of claim 1 wherein said housing includes an interchangeable decorative housing cover.

7. The power switch control unit of claim 1 which further includes a dimmer for controlling the intensity of a light connected to said power switch control unit.

8. The power switch control unit of claim 1 which further includes a dimmer for adjusting brightness of said display.

9. A power switch control unit for controlling the operation of a controlled electric device connected to the unit, comprising:

a housing having a timing mechanism therein;

a power cord having a plug on one end thereof, for connection to a power supply, and includes plural receptacles for connection of plural electric devices to said power switch control unit, and having said housing on the other end thereof, for supplying electrical power to the unit and to a connected-electric device controlled by the power switch control unit, and which further includes a selector switch for selectively operating said plural electric devices, and includes an indicator for indicating which of said plural electric devices is selected by said selector switch for control, and a receptacle for receiving a power cord from said electric device to be controlled by the power switch control unit;

control buttons, including:

a button for connecting a controlled electric device to the power supply;

a timer activation button for activating said timing mechanism, wherein, when said timing mechanism is activated, said timing mechanism connects a controlled electric device to the power supply for a predetermined amount of time in a timed cycle, and then disconnects the connected-electric device from the power supply, wherein said timing mechanism operates for a predetermined amount of time in a timed cycle upon operation of the timer activation button, and wherein multiple operations of the timer activation button program the timing mechanism to operate for multiple, sequential timed cycles; and wherein the length of a timed cycle is user adjustable; and a clear timer button for terminating the predetermined amount of time, and a display for displaying time remaining in said predetermined period of time.

10. The power switch control unit of claim 9 wherein said display includes an indicator for indicating which of said plural electric devices is selected by said selector switch for control.

11. The power switch control unit of claim 9 wherein said plug includes safety and power conditioning devices taken from the group of safety and power conditioning devices including GFI (Ground Fault Interrupter), AFCI (Arc Fault Circuit Interrupter) and circuit breakers.

12. The power switch control unit of claim 9 wherein said housing includes an interchangeable decorative housing cover.

13. The power switch control unit of claim 9 which further includes a dimmer for controlling the intensity of a light connected to said power switch control unit; and a dimmer for adjusting brightness of said display.

14. A power switch control unit for controlling the operation of a controlled electric device connected to the unit, comprising:

a housing having a timing mechanism therein;

a power cord having a plug on one end thereof, for connection to a power supply, and having said housing on the other end thereof, for supplying electrical power to the unit and to a connected-electric device controlled by the power switch control unit, and plural receptacles for receiving a power cord from plural, connected-electric devices to be controlled by the power switch control unit;

control buttons, including:

a button for connecting a controlled electric device to the power supply;

a timer activation button for activating said timing mechanism, wherein, when said timing mechanism is activated, said timing mechanism connects a controlled electric device to the power supply for a predetermined amount of time in a timed cycle, and then disconnects the connected-electric device from the power supply;

a selector switch for selectively operating said plural electric devices;

a clear timer button for terminating the predetermined amount of time, and a display for displaying time remaining in said predetermined period of time, including an indicator for indicating which of said plural electric devices is selected by said selector switch for control.

15. The power switch control unit of claim 14 wherein said timing mechanism operates for a predetermined amount of time in a timed cycle upon operation of the timer activation button, and wherein multiple operations of the timer activation button program the timing mechanism to operate for multiple, sequential timed cycles; and wherein the length of a timed cycle is user adjustable.

16. The power switch control unit of claim 14 wherein said plug includes safety and power conditioning devices taken from the group of safety and power conditioning devices including GFI (Ground Fault Interrupter), AFCI (Arc Fault Circuit Interrupter) and circuit breakers.

* * * * *